US005143464A

United States Patent [19]

Susini et al.

[11] Patent Number: 5,143,464

[45] Date of Patent: Sep. 1, 1992

[54] CASE WITH ROTARY MECHANISM FOR SUBSTANCES IN STICK FORM

[75] Inventors: Claude Susini, Sennecey Le Grand; Pascal Mejean, Veyrier du Lac, both of France

[73] Assignee: Reboul-SMT, Créteil, France

[21] Appl. No.: 711,073

[22] Filed: Jun. 6, 1991

[30] Foreign Application Priority Data

Jun. 8, 1990 [FR] France ..... 90 07133

[51] Int. Cl.[5] ..... A45D 40/06; A45D 40/12

[52] U.S. Cl. ..... 401/78; 401/69; 401/74; 401/87

[58] Field of Search ..... 401/78, 74–76, 401/87, 69, 116, 173

[56] References Cited

U.S. PATENT DOCUMENTS

| | | | |
|---|---|---|---|
| 2,072,662 | 3/1937 | Abbotts | 401/78 |
| 2,302,473 | 11/1942 | Reichenbach | 401/78 |
| 2,352,448 | 6/1944 | Ruchenbach | 401/78 |
| 2,504,490 | 4/1950 | Broder | 401/78 |
| 2,704,598 | 3/1955 | Casey | 401/78 |
| 3,488,127 | 1/1970 | Gruska | 401/78 |
| 3,512,896 | 5/1970 | Gruska | 401/78 |
| 3,547,551 | 12/1970 | Gruska | 401/78 |
| 4,108,668 | 8/1978 | Radice et al. | 401/78 |
| 4,750,501 | 6/1988 | Ackermann et al. | 401/78 X |

FOREIGN PATENT DOCUMENTS

| | | |
|---|---|---|
| 68120 | 4/1958 | France . |
| 92916 | 1/1969 | France . |
| 2380752 | 9/1978 | France . |
| 361096 | 5/1962 | Switzerland . |
| 506428 | 5/1939 | United Kingdom ..... 401/78 |

*Primary Examiner*—Danton D. DeMille
*Attorney, Agent, or Firm*—Foley & Lardner

[57] ABSTRACT

In a case equipped with a rotary mechanism for substances in stick form, the danger of accidental disengagement of the nipples of the sliding cup from the guide sleeves at the end of travel of the nipples is eliminated by inserting the edges of the walls of the slots of the inner sleeve within channels formed in the nipples.

6 Claims, 2 Drawing Sheets

FIG. 4
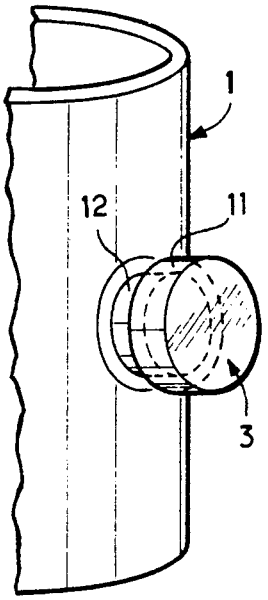
FIG. 5
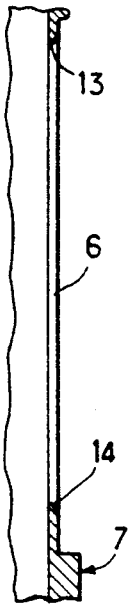
FIG. 6
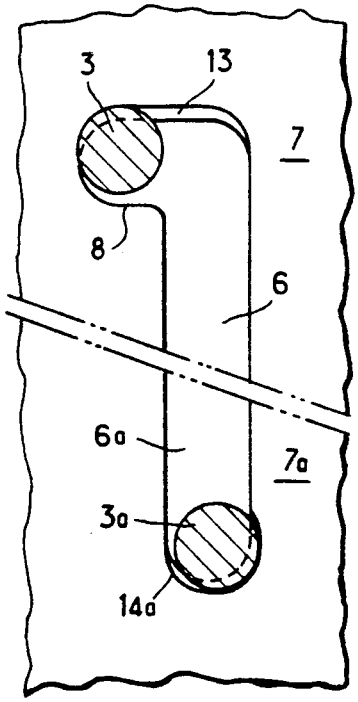
FIG. 7
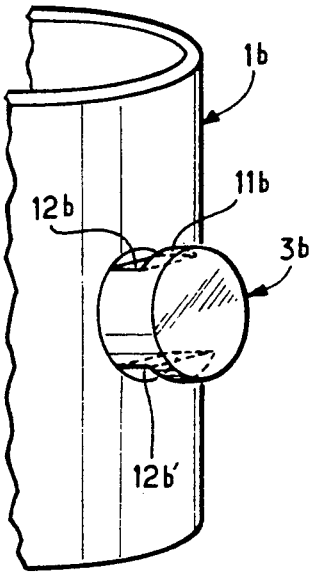
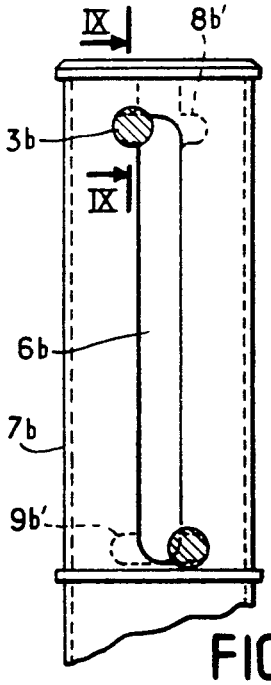
FIG. 8
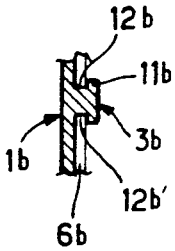
FIG. 9

CASE WITH ROTARY MECHANISM FOR SUBSTANCES IN STICK FORM

BACKGROUND OF THE INVENTION

1. Field of the Invention

The present invention relates to the packaging industry, more specifically for packaging sticks of substances of the lipstick type in cases having a rotary lifting mechanism which makes it possible to move the stick out of the case at the time of use without separating it from the case, then to withdraw it into the case until the next time it is used.

2. Description of the Prior Art

A conventional case has a stick-holder cup which is capable of sliding axially within two mutually rotating concentric coaxial sleeves, namely a stationary outer sleeve and a rotary inner sleeve. In the outer sleeve are cut two internal helical grooves symmetrically displaced by 180°. The rotary inner sleeve has two diametrically opposite and symmetrical longitudinal slots, each slot being branched-off at 90° into a recess at each end of travel of the cup. The recess is oriented in the direction opposite to the rotation of the sleeve which brings the cup to this end of its travel. The cup has two radial nipples relatively displaced by 180°, and each nipple passes respectively through a slot so as to penetrate into a groove at its distal end.

For reasons of appearance and cost, it is standard practice to construct the mechanisms of these cases from thin materials which usually consist of plastics. The mechanical strength of plastics proves suitable for normal use, but may sometimes be insufficient to prevent the nipples from escaping from the channels and the slots when an excessive twist is exerted at the end of travel of the cup. The accidental disengagement thus produced has an adverse effect on the subsequent operation of the mechanism. In order to overcome this drawback, the thickness of the wall inner and of the outer sleeves is increased to the maximum extent which is compatible with a commercially acceptable diameter of the case, while endeavoring to find a compromise with attractiveness of appearance and cost. The compromise cannot be fully satisfactory.

The object of the invention is to overcome this disadvantage of conventional cases and to prevent accidental disengagement of the rotary mechanisms even with thin-walled sleeves.

SUMMARY OF THE INVENTION

The invention relates to a case of the aforementioned type for a substance in stick form, said case being distinguished by the fact that the helical grooves have a width adapted to that of the nipple heads and greater than the width of the recesses, the nipples being provided with symmetrically-cut channels located opposite to the inner sleeve and having a width adapted to the thickness of the inner sleeve and a depth corresponding to a spacing which is adapted to the width of the recesses, with the result that the nipples slide readily with a small clearance within the helical grooves, the slots and the recesses, but grip with slight friction the oppositely-facing edges of the wall of the inner sleeve, at least within the recesses.

The longitudinal slots can have the same width as the recesses, in which case the nipple channels are circular, or else the longitudinal slots can have the same width as the helical grooves, in which case the nipple channels form notches parallel to the orientation of the recesses.

The outer edge of the wall of the inner sleeve can be chamfered, at least at the bottom ends of the recesses, in order to apply the nipples more effectively against the internal face of said wall and to facilitate entry of the nipples into the recesses. It is even possible to reduce the recesses corresponding to the withdrawn position of the stick within the case to a chamfered external lateral edge of the end portion of each longitudinal slot.

It is also possible to prevent accidental disengagement with even greater effectiveness by providing the inner sleeve and the outer sleeve with complementary stops for limiting the relative rotation between the sleeves to less than one revolution and positively determining the ends of travel of the cup.

A more complete understanding of the invention will be gained from the following detailed description and from the accompanying drawings in which a few embodiments have been selected solely by way of example from the many forms of execution, adaptations and variants of the invention within the capacity of those versed in the art.

BRIEF DESCRIPTION OF THE DRAWINGS

FIG. 4 is a schematic detail view in perspective and to a larger scale showing a nipple of the cup of the case of FIGS. 1 to 3.

FIG. 5 is a schematic view in elevation and in axial cross-section showing a chamfered longitudinal slot of a case sleeve in accordance with the invention.

FIG. 6 is a schematic front view of the slot of FIG. 5.

FIG. 7 is a view which is similar to FIG. 4 and shows an alternative embodiment.

FIG. 8 is a schematic front view in elevation illustrating a sleeve with longitudinal slots and showing the end-of-travel positions of the nipples of the cup of FIG. 7.

FIG. 9 is a schematic view in cross-section along line IX—IX of FIG. 8.

DESCRIPTION OF THE PREFERRED EMBODIMENTS

Figure 1:
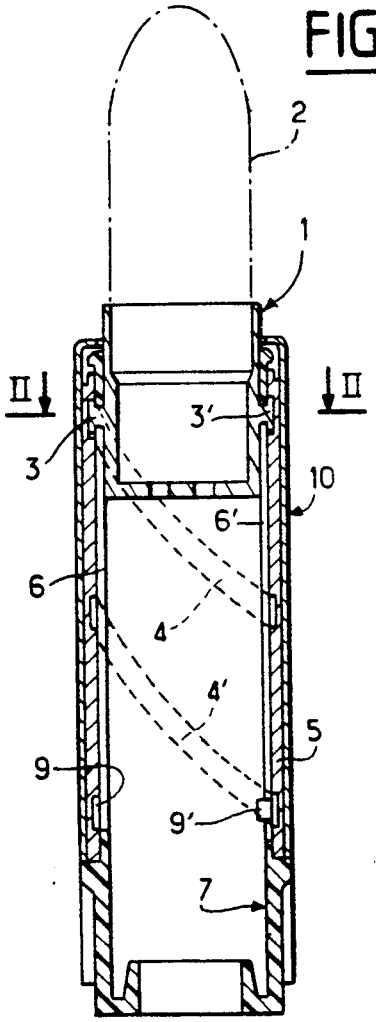
FIG. 1 is a schematic view in elevation and in axial cross-section showing a case in accordance with the invention.

In these figures, corresponding elements are designated by the same reference numerals to which an index may be assigned. For the sake of enhanced clarity of the drawings, the respective dimensions and proportions of these elements are not drawn to scale.

The case for a substance in the form of a stick such as lipstick as illustrated in FIGS. 1 to 4 essentially includes a cup 1 for holding a stick 2. Said cup 1 has two diametrically opposite radial nipples 3, 3', the distal ends of which slide within symmetrically opposite helical grooves 4, 4' cut in the internal face of an outer sleeve 5 after having passed through longitudinal slots 6, 6' of an inner sleeve 7 which is concentric with the outer sleeve 5 and in mutually rotating relation therewith. At each end of travel of the cup 1, each slot 6, 6' branches-off at 90° into a recess 8, 8', 9, 9' which is oriented in the direction opposite to the rotation of the inner sleeve 7 so as to bring the cup 1 to this end of its travel. An external sheath 10, which may be decorative if so desired, is fitted around the outer sleeve 5.

The heads 11, 11' of the nipples 3, 3' are slightly smaller in width than the helical grooves 4, 4'in which they slide freely but are of greater width than the recesses 8, 8', 9, 9'. Channels 12, 12' are cut symmetrically in a proximal portion of said nipples 3, 3' opposite to the wall of the inner sleeve 7. These channels have a width which is slightly greater than the thickness of the inner sleeve 7 and a depth which is slightly smaller than the width of the recesses 8, 8', 9, 9'.

Thus the nipples 3, 3' are capable of sliding freely with a small clearance within the grooves 4, 4'through the slots 6, 6' and the recesses 8, 8', 9, 9'while gripping with slight friction the oppositely-facing edges of the inner sleeve 7 within the recesses at each end of travel of the cup 1, thus guarding against any danger of accidental disengagement caused by escape of the nipples from the recesses.

Figure 2:
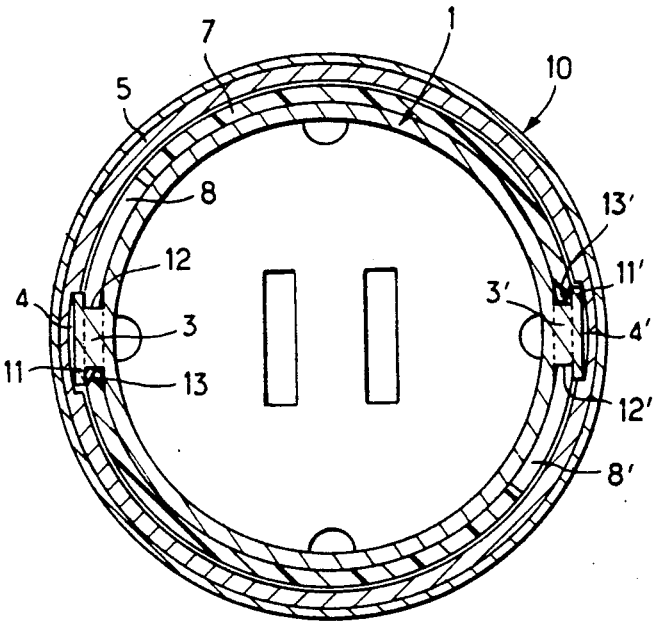
FIG. 2 is a schematic view in diametral cross-section to a larger scale, this view being taken along line II—II of FIG. 1.

In order to ensure good insertion of the channels 12, 12' within the recesses 8, 8', 9, 9', the outer edges of the sleeve wall can be chamfered as indicated at 13, 13', 14 in FIGS. 2, 5 and 6.

In an alternative embodiment shown in the lower portion of FIG. 6, the recess is reduced to a chamfered edge 14*a* of the end portion of the slot 6*a*, which permits gripping of the wall of the sleeve 7*a* within the channel of the nipple 3*a* with immobilization of the cup at the bottom end of travel. In this position, the cup together with its stick are withdrawn within the case and are not subjected to any stress as at the time of frictional application of the stick against a surface when the stick is extended outwards from the case at the other end of travel of the cup. In this other position, the slot should preferably be provided with an extension in the form of a lateral recess having a length at least equal to the diameter of the nipple 3 in order to ensure good axial locking of the cup.

FIGS. 7 and 8 illustrate another alternative embodiment of the invention in which the channels of the nipple 3*b* are formed by two notches 12*b*, 12*b* which are parallel to the axis of the recesses 8*b*, 8*b*'. The clearance between the bottom faces of the notches of a nipple is slightly smaller than the width of the recesses into which the nipples penetrate.

Figure 11:
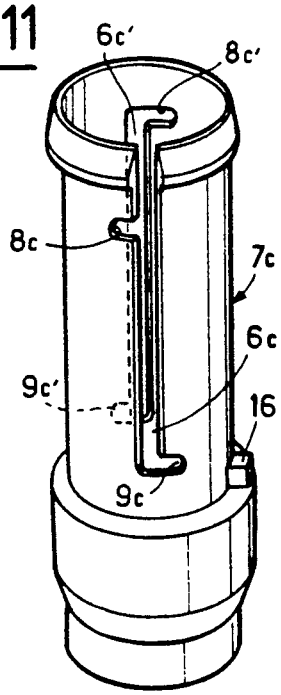
FIG. 11 is a schematic view in perspective showing a sleeve with longitudinal slots and a stop for complementary limitation of rotation of the sleeve of FIG. 10.
Figure 10:
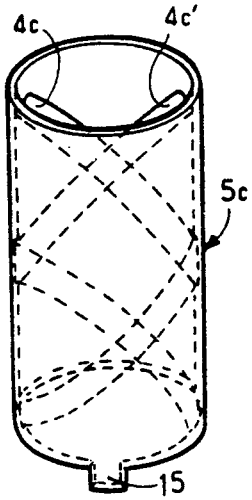
FIG. 10 is a schematic view in perspective showing a sleeve with helical grooves and a rotation-limiting stop for a case in accordance with the invention.
Figure 3:
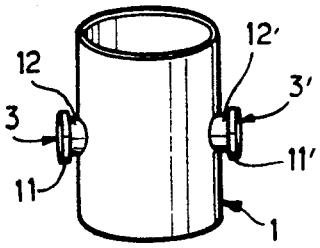
FIG. 3 is a schematic view in perspective showing the cup of the case of FIGS. 1 and 2.

In order to ensure more positive rotational locking at each end of travel of the cup, a stop lug 15 can advantageously be provided at one end of the sleeve 5*c* having helical grooves. The stop lug is adapted to cooperate with another stop lug 16 on the corresponding end of the sleeve 7*c* having longitudinal slots, as shown in FIGS. 10 and 11. The width of said lugs 15, 16 limits the relative rotation of the sleeves 5*c* and 7*c* to a little less than one revolution, which is not objectionable for a practical design of a lipstick case.

What is claimed is:

1. A case for a substance in stick form and in particular lipstick, comprising two mutually rotating concentric coaxial sleeves, and a stick-holder cup adapted to slide axially within the two sleeves, the sleeves including a stationary outer sleeve and a rotary inner sleeve, the outer sleeve being provided with two internal helical grooves symmetrically displaced by 180°, the rotary inner sleeve being provided with two diametrically opposite and symmetrical longitudinal slots, each slot being branched-off at 90° into a recess at each end of travel of the cup, said recess having an orientation opposite to the rotation of the sleeve which brings the cup to an end of its travel, said recess having a width less than the width of said helical grooves, said cup being provided with two radial nipples relatively displaced by 180°, each nipple having a proximal portion including a first section adapted to slide snugly in said longitudinal slot and said recesses, and a distal portion including a second section adapted to slide snugly in said helical groove, said first section being reduced with respect to said second section, so that said nipples when engaged in said recesses are prevented from accidental disengagement through the abutment of said distal portion over edges of the recesses.

2. A case according to claim 1, wherein the longitudinal slots have the same width as the recesses and the nipples are provided at their proximal portion with an annular groove.

3. A case according to claim 1, wherein the longitudinal slots have the same width as the helical grooves, and the nipples are provided at their proximal portion with notches parallel to the orientation of the recesses.

4. A case according to claim 1, wherein the inner sleeve and the outer sleeve include complementary stops for limiting a relative rotation between the sleeves to less than one revolution, and for determining the ends of the travel of the cup.

5. A case for a substance in stick form and in particular lipstick, comprising two mutually rotating concentric, coaxial sleeves, and a stick holder cup adapted to slide axially within the two sleeves, the sleeves including a stationary outer sleeve and a rotary inner sleeve, the outer sleeve being provided with two internal helical grooves symmetrically displaced by 180°, the rotary inner sleeve being provided with two diametrically opposite and symmetrical longitudinal slots, each slot being branched-off at 90° into a recess at each end of travel of the cup, the recess having an orientation opposite to a rotation of the sleeve which brings the cup to an end of its travel, the inner sleeve including a wall with an outer edge which is chamfered at least at a bottom portion of the recess, the cup being provided with two radial nipples relatively displaced by 180°, each nipple having a proximal portion including a first section adapted to slide in the longitudinal slot and the recesses, and a distal portion including a second section adapted to slide in the helical groove, the first section being reduced with respect to the second section, so that the nipples when engaged in the recesses are prevented from accidental disengagement through the abutment of the distal portion over edges of the recesses.

6. A case according to claim 5, wherein the recess corresponding to a withdrawn position of the stick within the case is a chamfered external lateral edge of an end portion of the longitudinal slot.

* * * * *